US010746389B2

(12) United States Patent
Brunelli et al.

(10) Patent No.: US 10,746,389 B2
(45) Date of Patent: Aug. 18, 2020

(54) WALL PACK LUMINAIRE AND THERMAL INSERT FOR LUMINAIRES

(71) Applicant: Hubbell Incorporated, Shelton, CT (US)

(72) Inventors: Anthony Brunelli, Piedmont, SC (US); John Lane, Simpsonville, SC (US); Allen George Cyr, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 255 days.

(21) Appl. No.: 15/487,749

(22) Filed: Apr. 14, 2017

(65) Prior Publication Data

US 2017/0299170 A1 Oct. 19, 2017

Related U.S. Application Data

(60) Provisional application No. 62/324,589, filed on Apr. 19, 2016.

(51) Int. Cl.

| | |
|---|---|
| ***F21V 29/76*** | (2015.01) |
| ***F21V 15/01*** | (2006.01) |
| ***F21V 23/00*** | (2015.01) |
| ***F21S 8/00*** | (2006.01) |
| ***F21S 9/02*** | (2006.01) |
| ***F21V 5/04*** | (2006.01) |
| ***F21V 5/08*** | (2006.01) |
| *F21V 17/10* | (2006.01) |
| *F21V 29/83* | (2015.01) |

(Continued)

(52) U.S. Cl.

CPC ..... *F21V 29/76* (2015.01); *F21S 8/033* (2013.01); *F21S 9/022* (2013.01); *F21V 5/04* (2013.01); *F21V 5/08* (2013.01); *F21V 15/01* (2013.01); *F21V 23/003* (2013.01); *F21V 3/049* (2013.01); *F21V 17/107* (2013.01); *F21V 29/83* (2015.01); *F21Y 2115/10* (2016.08)

(58) Field of Classification Search

CPC .. F21S 8/033; F21S 9/022; F21V 5/04; F21V 5/08; F21V 29/76; F21V 23/003

See application file for complete search history.

(56) References Cited

U.S. PATENT DOCUMENTS

| | | | |
|---|---|---|---|
| 4,507,719 | A | 3/1985 | Quiogue |
| 8,342,709 | B2 | 1/2013 | Lueken |

(Continued)

OTHER PUBLICATIONS

PCT/US2017/027602 International Search Report and Written Opinion dated Aug. 1, 2017 (15 pages).

*Primary Examiner* — Karabi Guharay

(74) *Attorney, Agent, or Firm* — Michael Best & Friedrich, LLP

(57) ABSTRACT

A luminaire includes a rear housing section having an opening in communication with an exterior environment. A cover is connected to the rear housing section. An insert extends between the rear housing section and the cover. The insert includes a base and a fin member extending from the base. An air passageway is formed between the insert and the cover and is in fluid communication with the opening. A control component is connected to the base. A light emitter assembly is connected to the insert and controlled by the control component. The insert provides thermal communication between the control component and the light emitter and the fluid passageway.

15 Claims, 16 Drawing Sheets

(51) Int. Cl.
*F21Y 115/10* (2016.01)
*F21V 3/04* (2018.01)

(56) References Cited

U.S. PATENT DOCUMENTS

| | | | | |
|---|---|---|---|---|
| 9,016,892 | B1 | 4/2015 | Scribante et al. | |
| 9,109,787 | B2 | 8/2015 | Nankil | |
| 9,523,491 | B2 | 12/2016 | Bailey | |
| 2010/0002432 | A1 | 1/2010 | Romano | |
| 2011/0246146 | A1* | 10/2011 | Kauffman | F21K 9/00 703/2 |
| 2012/0087118 | A1 | 4/2012 | Bailey et al. | |
| 2014/0376221 | A1 | 12/2014 | Eliason et al. | |
| 2015/0345772 | A1 | 12/2015 | Duckworth et al. | |

* cited by examiner

WALL PACK LUMINAIRE AND THERMAL INSERT FOR LUMINAIRES

RELATED APPLICATION(S)

This application is based on U.S. provisional application Ser. No. 62/324,589, filed Apr. 19, 2017, the disclosure of which is incorporated herein by reference in its entirety and to which priority is claimed.

FIELD

Various exemplary embodiments relate to luminaire assemblies and components for luminaires.

BACKGROUND

Light fixtures, or luminaires, are used with electric light sources to provide an aesthetic and functional housing in both interior and exterior applications. Wall pack luminaires are generally used for exterior lighting of buildings around walkways and exit doors, and in interior applications such as hallways, entryways, or other areas. Wall pack luminaires are typically mounted to walls or other similar structure and provide downward light distribution from an elevated position.

In recent years, lighting applications, including area lights have trended towards the use of light emitting diodes (LEDs) as a light source in place of conventional incandescent and fluorescent lamps. The use of LED light sources has led to unique thermal considerations in luminaires. LEDs and their control components, such as drivers, circuitry, and battery backups, produce more heat than traditional light sources. Moreover, LEDs can degrade over time if exposed to high levels of heat. Because of these considerations, the internal layout and thermal considerations for each luminaire is unique.

SUMMARY

According to an exemplary embodiment, a luminaire includes a rear housing section having an opening in communication with an exterior environment. A cover is connected to the rear housing section. An insert extends between the rear housing section and the cover. The insert includes a base and a fin member extending from the base. An air passageway is formed between the insert and the cover and is in fluid communication with the opening. A control component is connected to the base. A light emitter assembly is connected to the insert and controlled by the control component. The insert provides thermal communication between the control component and the light emitter and the fluid passageway.

According to another exemplary embodiment, a luminaire includes a rear housing section and a cover connected to the rear housing section. An insert extends between the rear housing section and the cover. The insert includes a base and a fin member extending from the base. A set of control components are positioned in the housing with at least one control component connected to the base. A light emitter assembly is connected to the insert and controlled by the control components. The light emitter assembly includes a first set of light emitters, a first set of optics positioned over the first set of light emitters, a second set of light emitters, and a second set of optics positioned over the second set of light emitters. The control components are configured to operate the light emitters assembly in a normal mode having a first light distribution and an emergency mode having a second light distribution different than the first light distribution.

According to another exemplary embodiment, an insert for conducting heat in a luminaire includes a base having an upper portion, a lower portion, a front portion, and a rear portion. A lower fin portion extends from the lower portion of the base. An upper fin portion extends from the upper portion of the base and curves from the front portion of the base toward the rear portion of the base.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
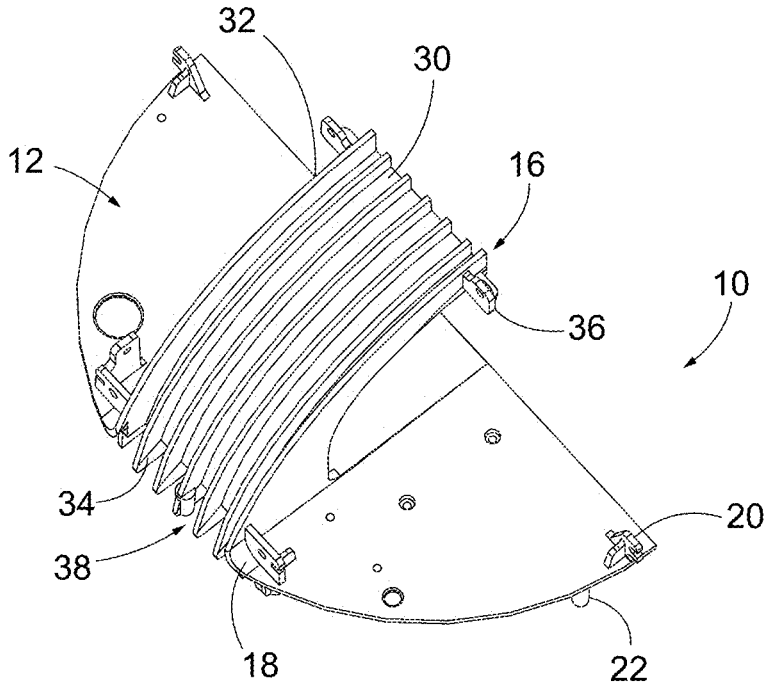
FIG. 1 is a top perspective view of an exemplary luminaire insert.
Figure 2:
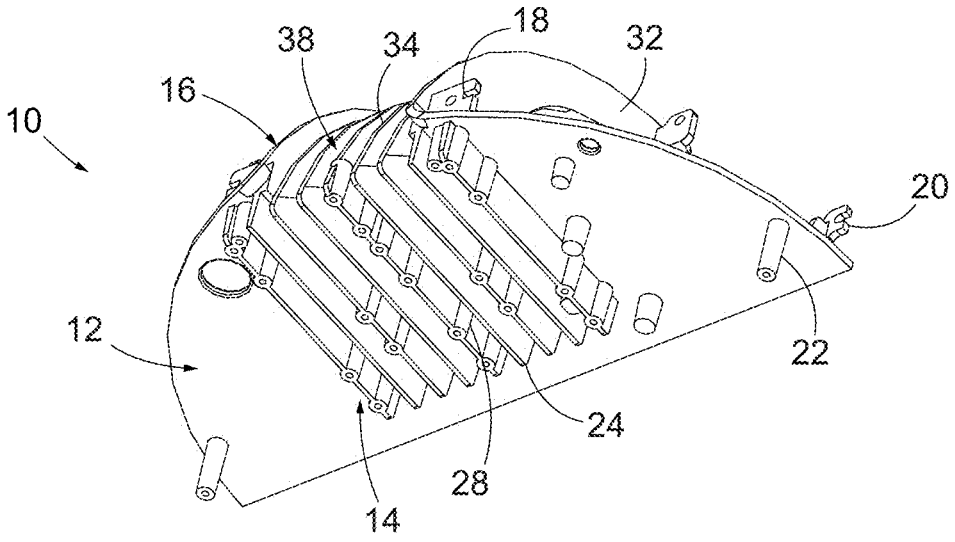
FIG. 2 is a bottom perspective view of FIG. 1.
Figure 3:
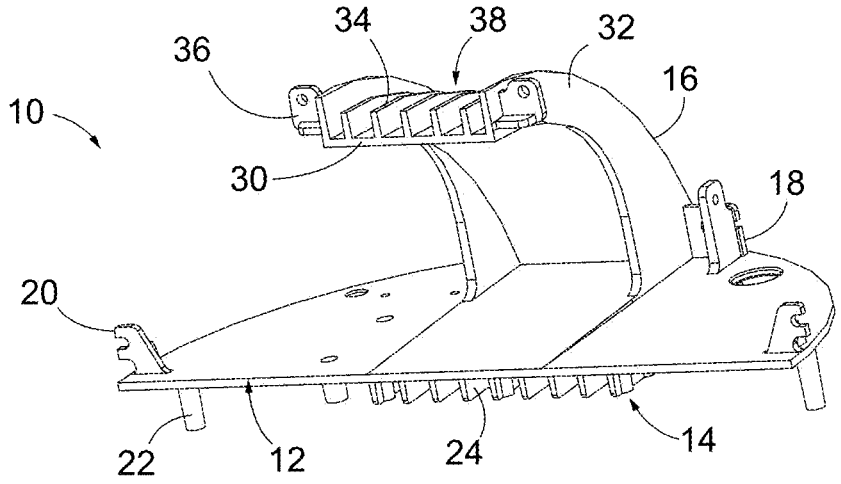
FIG. 3 is a rear perspective view of FIG. 1.
Figure 4:
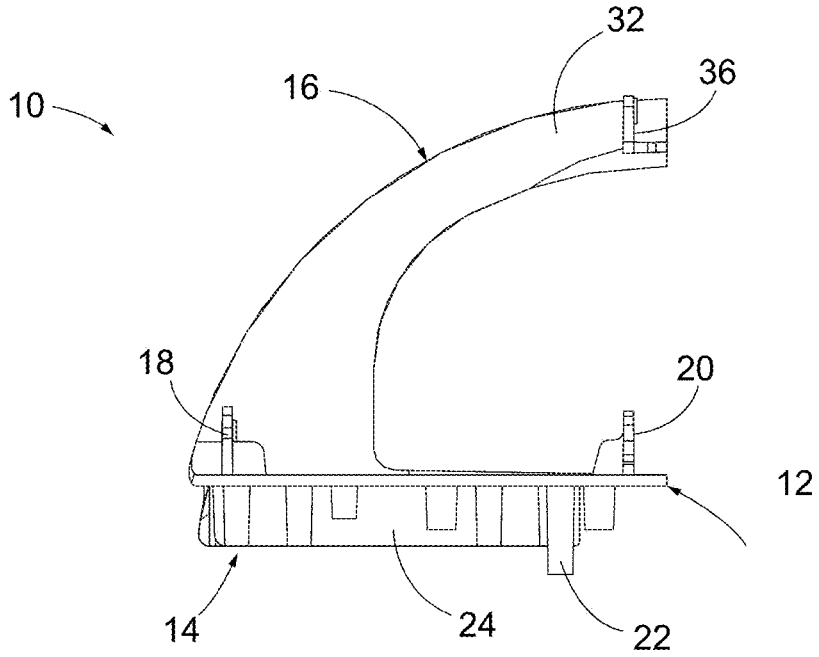
FIG. 4 is a side view of FIG. 1.

Various exemplary embodiments of this application are directed to luminaire components that provide a base assembly so that different exterior and interior components can be used with the base components to provide different aesthetic designs, interior controls, and light outputs. For example, common housings and/or mounting features can accommodate different configurations of luminaires that include one or more different types of light emitters, control components (such as drivers, surge protectors, fuses, batteries, photocells, occupancy sensors, wireless communication devices, etc.), and exterior features such as covers and lenses. The luminaire components also provide efficient thermal management across the range of configurations. This allows customers to customize a luminaire to a desired architectural design within the same product line.

FIGS. 1-5 show an exemplary embodiment of an insert 10 that is configured to be used in multiple luminaire housings. Various control components can be connected to the insert 10, allowing a single internal structure to be used for mounting desired control components and light emitters. The insert 10 also acts as a heat sink to transfer heat from the light emitters and the control components, and maintain a suitable internal temperature during operation. According to an exemplary embodiment, the insert 10 includes a base 12, a lower fin portion 14, and an upper fin portion 16.

The base 12 includes an upper portion and a lower portion. Mounting features allow control components to be connected to the upper portion of the base 12. The exemplary embodiment shows various openings and bosses that extend through or into the base 12. Other features such as clips or protrusions may also be used. The mounting features can directly connect control components or, in certain embodiments, brackets can be connected to the base 12 to retain various control components.

The upper portion of the base 12 includes one or more mounting components to connect the insert 10 to a luminaire housing section. In this exemplary embodiment, the base 10 includes a set of front mounting flanges 18 and a set of rear mounting flanges 20. The mounting flanges 18, 20 receive fasteners connecting the insert 10 to a housing section. One or more bosses 22 extend from the lower portion of the base 12 to connect to a housing section, for example through fasteners. The base 12 is shown having a semi-circular configuration which allows for a large mounting area but still gives the flexibility for mounting the insert 10 in different housing configurations. In alternative embodiments, other sizes, shapes, ad configurations can be used for the base 12.

The lower fin portion 14 includes a set of fins 24 that extend below the base. At least some of the fins 24 are configured to connect to a light emitter assembly or to a housing section. For example, one or more bosses 28 are formed in or around the fins 24 to receive fasteners connecting the light emitter assembly and/or a housing section. The fins 24 space the light emitter assembly from the bottom of the base 12, allowing air flow between the base 12 and the light emitter assembly through the open space in between the fins 24.

The upper fin portion 16 extends above the base 12 and curves, extending from a front section to a rear section of the base 12. The upper fin portion 16 includes a set of fins extending from a backing 30, with a pair of outer fins 32 and one or more central fins 34 positioned between the outer fins 32. In an exemplary embodiment, an upper edge of the outer fins 32 is positioned higher than an upper edge of the central fins 34. The outer fins 32 can also be continuous with an outer edge of the base 12.

The upper fin portion 16 includes one or more mounting components to connect the insert 10 to a luminaire housing section. In the illustrated exemplary embodiment, a set of mounting flanges 36 extend from the outer fins 32. The mounting flanges 36 receive fasteners used to connect the insert 10 to a housing section. In an exemplary embodiment, the upper fin portion 16 and the lower fin portion 14 combine to at least partially define an air passageway 38 allowing air to circulate around the lower and upper fin portions 14, 16.

Figure 5:
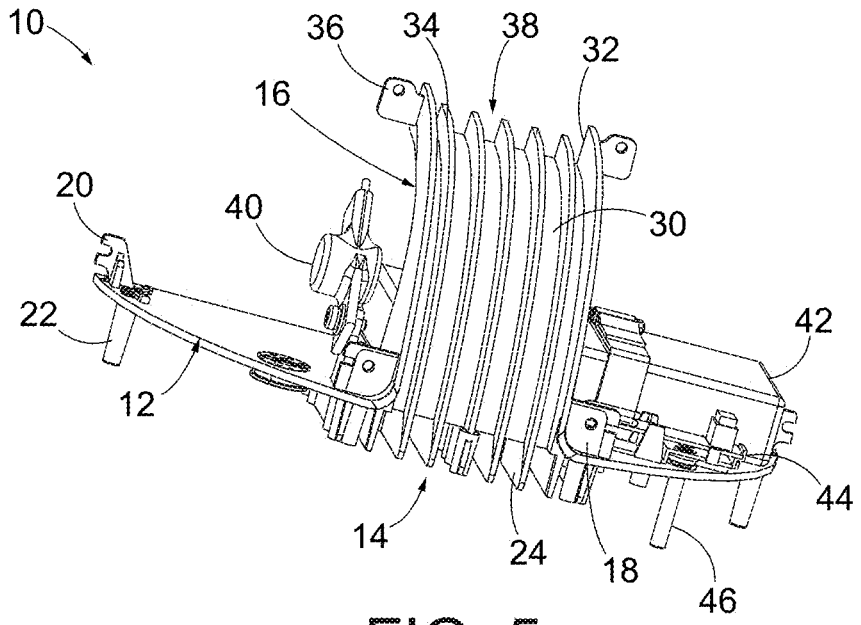
FIG. 5 is a front perspective view of the insert of FIG. 1 with exemplary control components.

FIG. 5 shows exemplary control components that can be connected to the insert including a surge suppressor 40, a battery pack 42, and a switch board 44. The surge suppressor 42 is connected to regulate the AC input. The battery pack 42 includes a battery and a heating element contained in a casing. The switch board 44 includes a circuit connected to a button that is accessible to a user from the exterior of a housing. One or more light pipes 46 can be connected to the insert 10 to convey status information to a user.

Figure 6:
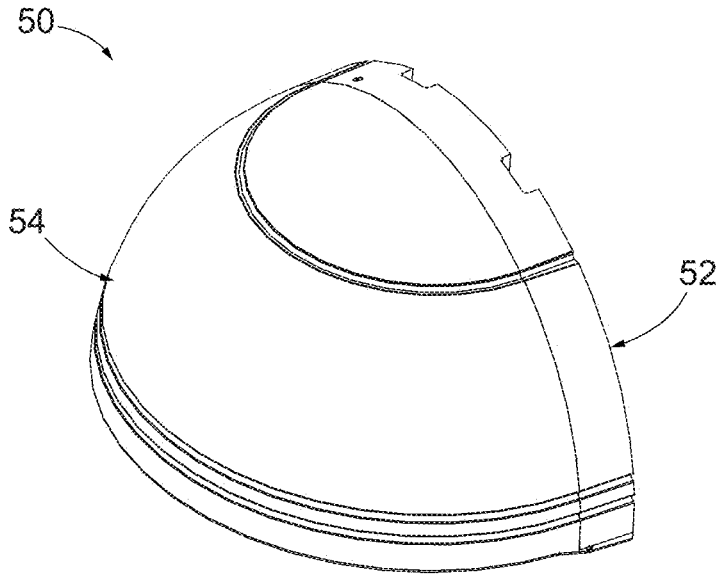
FIG. 6 is a top perspective view of an exemplary luminaire incorporating the inserted of FIG. 1.
Figure 7:
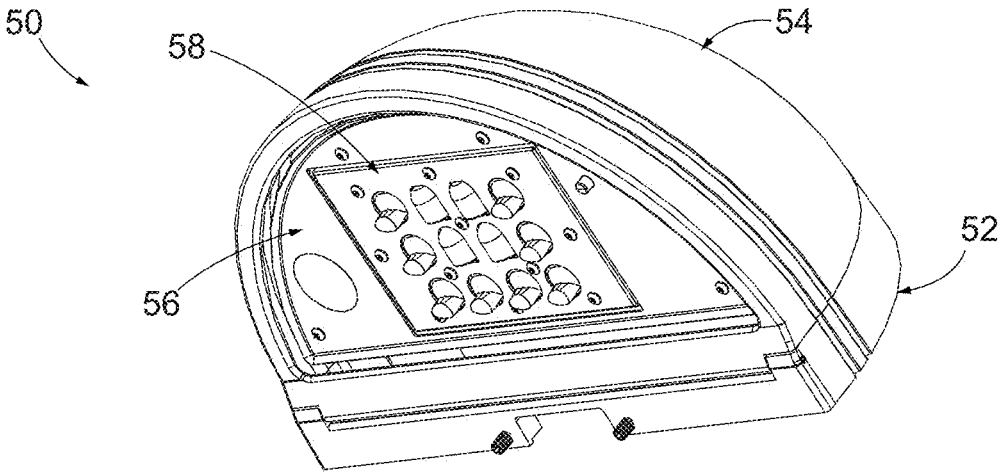
FIG. 7 is a bottom perspective view of FIG. 6.
Figure 8:
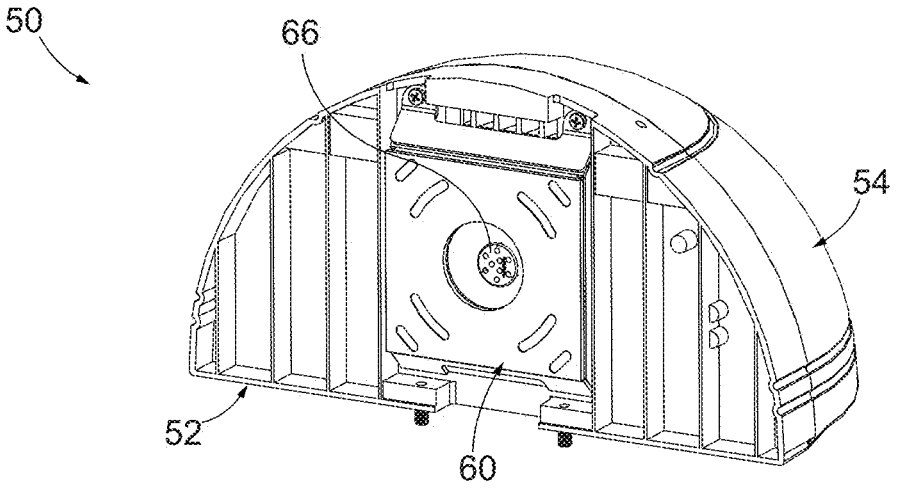
FIG. 8 is rear perspective view of FIG. 6.

FIGS. 6-8 show an exemplary embodiment of a quarter sphere luminaire housing 50 that includes a rear section 52, a cover 54, and a cover plate 56. The luminaire also includes a light emitter assembly 58 and a surface mounting assembly 60. The cover plate 56 surrounds the light emitter assembly 58. The surface mounting assembly 60 is connected to the rear section 52 to mount the luminaire on a surface such as a wall.

Figure 9:
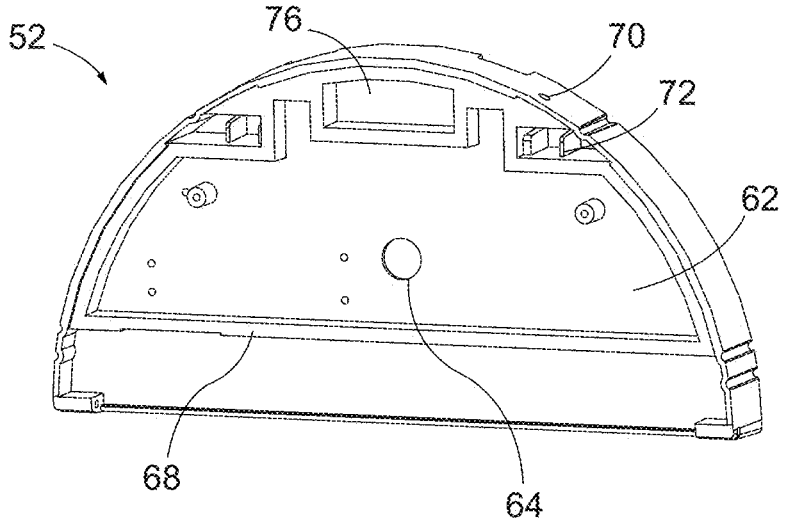
FIG. 9 is a front perspective view of the rear section of FIG. 6.

As shown in FIG. 9, the rear section 52 of the housing includes an inner wall 62 having a conductor opening 64 for allowing conductors to pass into the housing 50 to provide power to the luminaire. A conductor gasket 66 (shown in FIG. 8) can be positioned in or adjacent the conductor opening 64. Mounting features allow control components to be connected to the inner wall 62. The exemplary embodiment shows various openings and bosses that extend into and project from the inner wall 62. Other features such as clips or protrusions may also be used. The mounting features can directly connect control components or, in certain embodiments, brackets can be connected to the inner wall 62 to retain various control components. The rear section 52 also includes one or more mounting components for connecting the rear section 52 to the cover 54. For example, lower mounting components include a set of first hinge members 68 and upper mounting components include a pair of openings 70 aligned with a slot 72.

Figure 10:
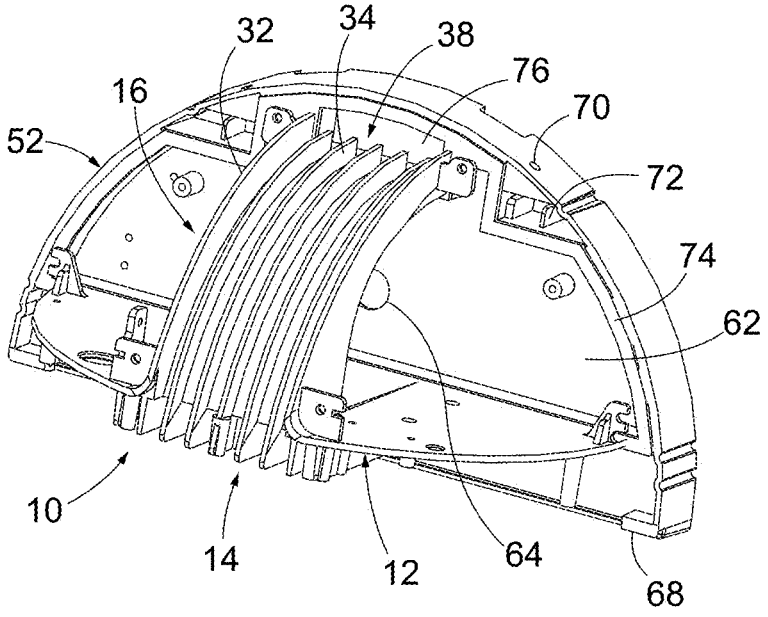
FIG. 10 is a front perspective view of the rear section of FIG. 6 and the insert.

A rim 74 extends from the inner wall 62 and an upper opening 76 extends through the inner wall 62. As best shown in FIG. 10, portions of the rim 74 align with the insert 10. For example, the bottom of the rim 74 aligns with the base 12 and portions of the rim 74 surrounding the upper opening 76 align with the upper fin portion 16 of the insert 10. In an exemplary embodiment, the backing 30 of the upper fin portion 16 is aligned with a section of the rim 74 below the upper opening 76 and a portion of the central fins 34 extend in front of the upper opening 76 while the outer fins 32 extend along the sides of the upper opening 76. The upper opening 76 therefore allows fluid communication between the air passageway 38 and the exterior of the housing 50.

Figure 11:
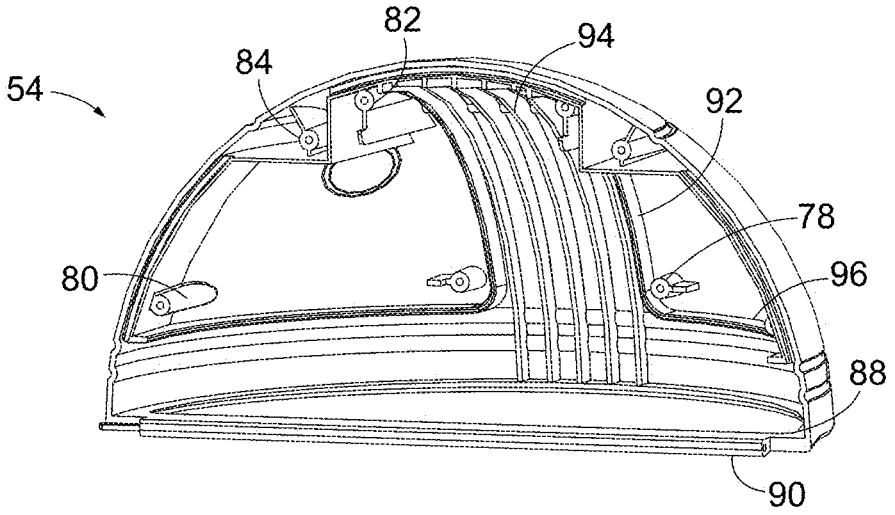
FIG. 11 is a rear perspective view of the cover of FIG. 6.

FIG. 11 shows an exemplary embodiment of the interior of the cover 54. The cover 54 includes one or more mounting components used to connect the insert 10 to the cover 54 and to connect the cover 54 to the rear section 52 of the housing 50. For example, the cover 54 includes a set of lower front bosses 78 and a set of lower rear bosses 80 for receiving fasteners that connect to the front and rear mounting flanges 18, 20 of the base 12. A first set of upper bosses 82 receives fasteners that connect to the mounting flanges 36 of the upper fin portion 16. A second set of upper bosses 84 receives fasteners that connect the cover 54 to the rear section 52. In an exemplary embodiment, an L-shaped bracket 86 (shown in FIG. 14) has a first portion that connects to the second set of upper bosses 84 and a second portion that extends into the slot 72 on the rear section 52 of the housing 50. Fasteners, for example set screws, extend through the openings 70 aligned with the slots 72 to engage the second portion of the L-shaped bracket 86.

The cover 54 includes a bottom rim 88 defining an opening that receives the cover plate 56 and the light emitter assembly 58. The cover plate 56 can be connected to the insert 10 by fasteners received in the mounting bosses 22 extending from the lower portion of the insert 10 and the bosses formed in or around the fins 24 on the lower fin portion 14. A rear portion of the bottom rim 88 includes a projection having a pair of side openings. The side openings act as a second set of hinge members 90 that are aligned with the first set of hinge members 68 on the rear section 52 of the housing 50. Pins can engage the first hinge members 68 and the second hinge members 90, pivotally connecting the cover 54 to the rear section 52.

Figure 12:
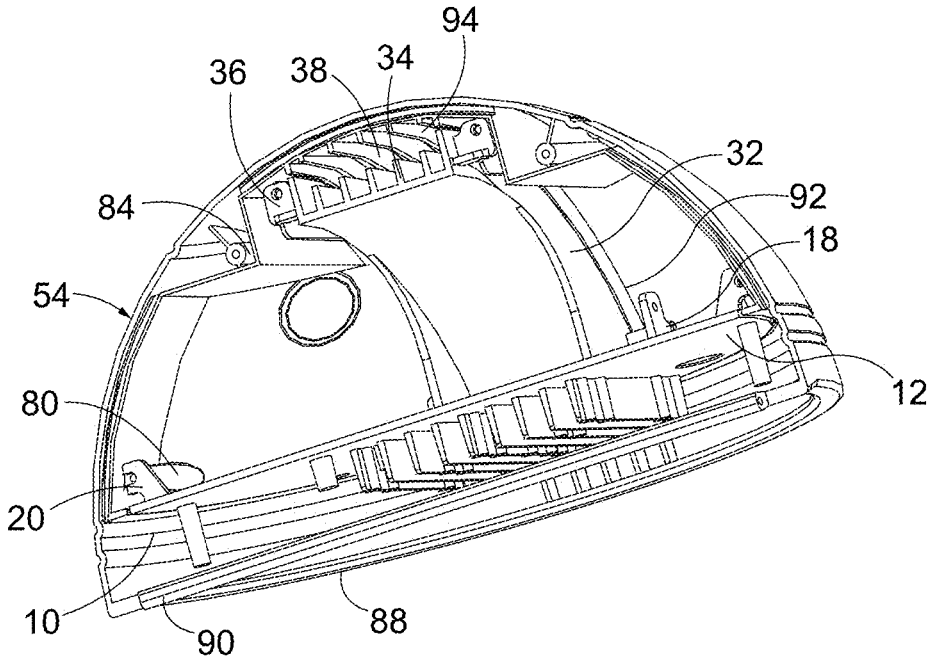
FIG. 12 is a rear perspective view of the cover and the insert.
Figure 13:
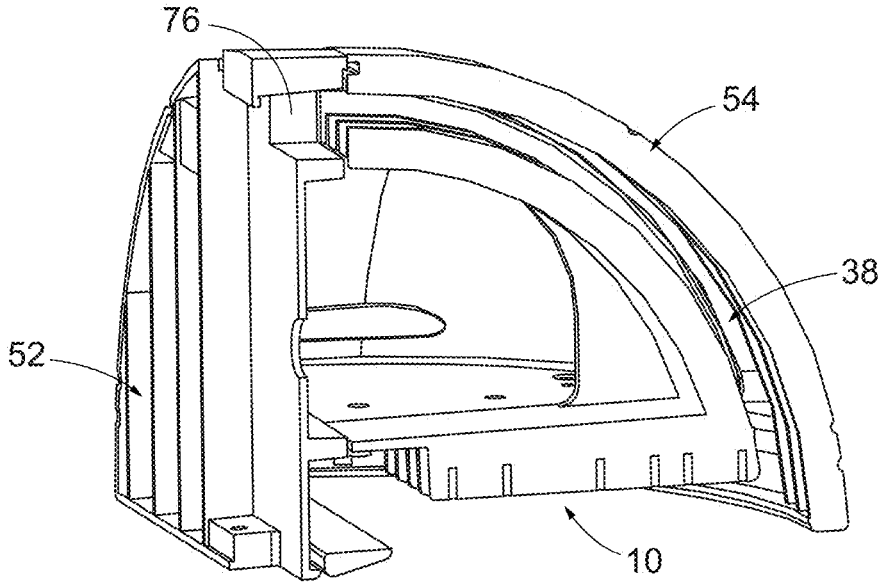
FIG. 13 is a sectional view of the rear section, cover, and insert of FIG. 6.

The cover 54 includes a set of fins projecting from the interior surface toward the insert 10. The fins include outer fins 92 and central fins 94 that are aligned with the outer fins 32 and central fins 34 of the insert 10. The outer fins 92 can be continuous with a rim 96 that is aligned with the edge of the base 12. FIG. 12 shows the insert 10 connected to the cover 54. The outer fins 92 of the cover 54 and the outer fins 32 of the insert 10 can extend adjacent one another to separate the air passageway 38 from the reminder of the housing interior. As best shown in FIG. 13, the air passageway 38 extends between the insert 10 and the cover 54 and has an outlet through the upper opening 76 in the rear section 52. The lower fin portion 14 and the upper fin portion 16 of the insert 10 can draw heat generated from the light emitter assembly 58 and the air passageway 38 helps to dissipate the generated heat to the exterior environment. The air passageway 38 helps to increase heat transfer and create a thermal barrier.

Figure 14:
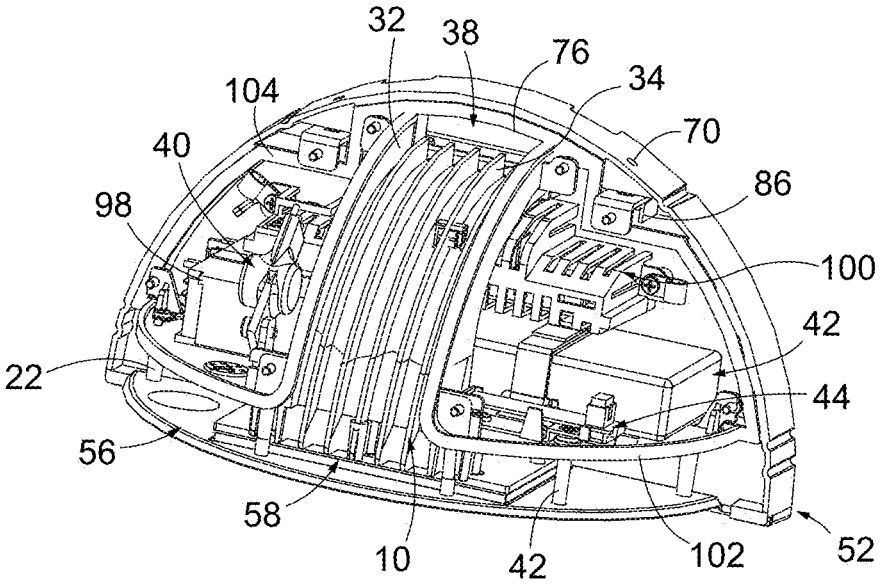
FIG. 14 is a front perspective view of the luminaire of FIG. 6 with the cover removed.
Figure 15:
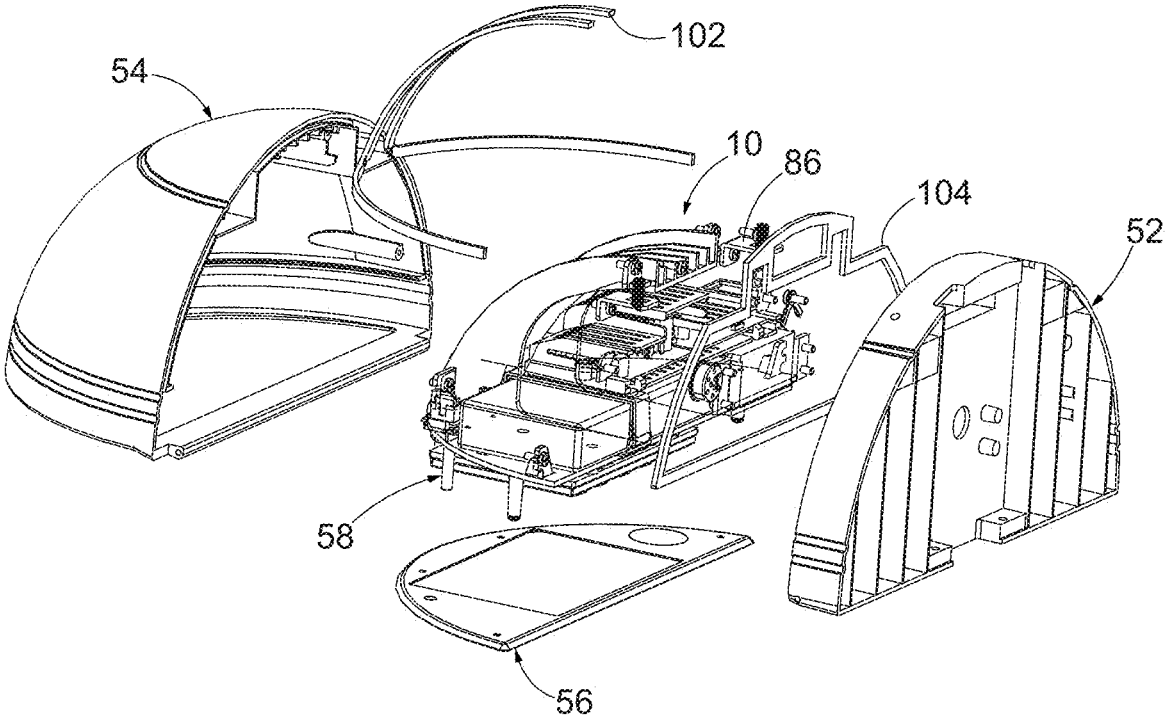
FIG. 15 is a partially exploded view of the luminaire of FIG. 6.

FIGS. 14 and 15 show an exemplary embodiment of control components that can be used with the luminaire. In addition to the control components shown in FIG. 5, FIGS. 14 and 15 show a main driver 98 and an emergency mode assembly 100. The main driver 98 provides power to the light emitter assembly 98 during normal operation. The emergency mode assembly 100 includes components capable of charging the battery and operating the light with a DC power source if AC power to the luminaire fails. The emergency mode assembly components can include circuitry capable of charging, monitoring, and discharging the battery and a DC driver contained in a high voltage cover. Other additional and/or alternative components may be used as would be understood by one of ordinary skill in the art.

In addition to the control components, first and second front insert gaskets 102 can be positioned between the insert 10 and the cover 54. For example, the front insert gaskets 102 can be positioned along the outer fins 32 and the front edge of the base 12 on the insert 10 and the outer fins 92 and the rim 96 on the cover 54. A rear gasket 104 can be positioned between the insert 10 and the rim 74 on the rear section 52 of the housing 50.

Figure 16:
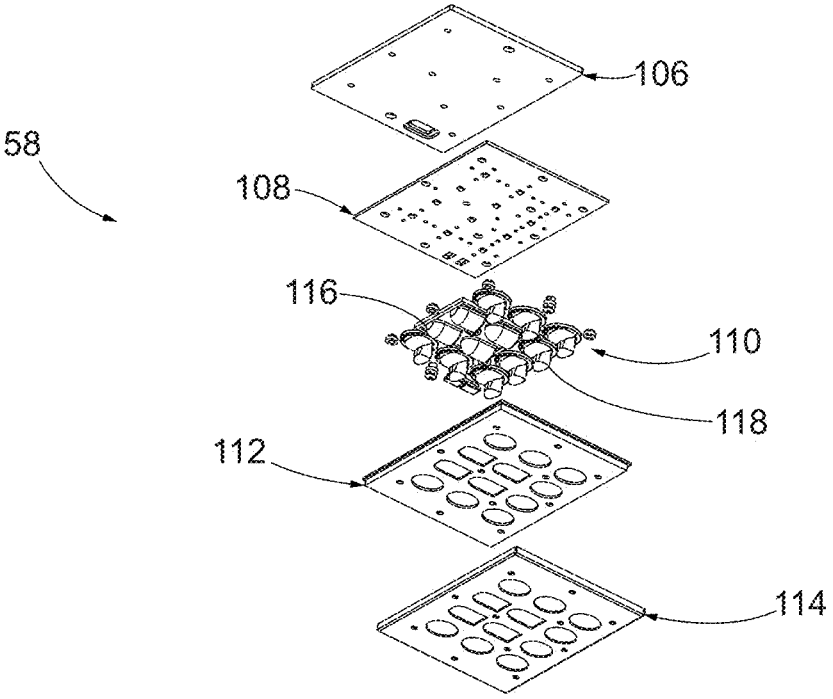
FIG. 16 is an exploded view of an exemplary light emitter assembly.

FIG. 16 shows an exemplary embodiment of a light assembly 58 that includes a base 106, an LED board 108, one or more optics 110, a gasket 112, and a bezel 114. The LED board 108 includes a printed circuit board (PCB) and one or more light emitting devices, for example LEDs, connected to the PCB. The optics 110 can be connected to the PCB over the LEDs to direct or diffuse the emitted light. The LED board gasket 112 is positioned between the LED board 108 and the bezel 114 to seal and protect the LED board 108. The LED board gasket 108 can be made from a polymer or elastomer material, for example silicone, although other materials may be used. The bezel 114 can be made from a metal, although other materials may also be used. Certain exemplary embodiments can utilize a lens positioned under the optics depending on the desired use. The lens can be colored and/or include light directing or diffusing elements such as prisms.

In an exemplary embodiment, the optics 110 include a first set of optics 116 and a second set of optics 118. The first set of optics 116 are positioned in the center and front of the light emitter assembly 58 and the second set of optics 118 are positioned around the first set of optics 116. The first and second optics 116, 118 can have different light distribution patterns. For example, the first set of optics 116 can have a forward throw light distribution that asymmetrically directs light mainly down and in front of the luminaire. The second set of optics 118 can have a more uniform light distribution. The first and second optics 116, 118 can be formed as discrete components with one component associated with each LED or they can be unitarily formed so that a component can include more than one optic and be associated with more than one LED. In an exemplary embodiment, the first set of optics 116 is a formed as a single, unitary component and the second set of optics 118 are formed as individual components.

Figure 17:
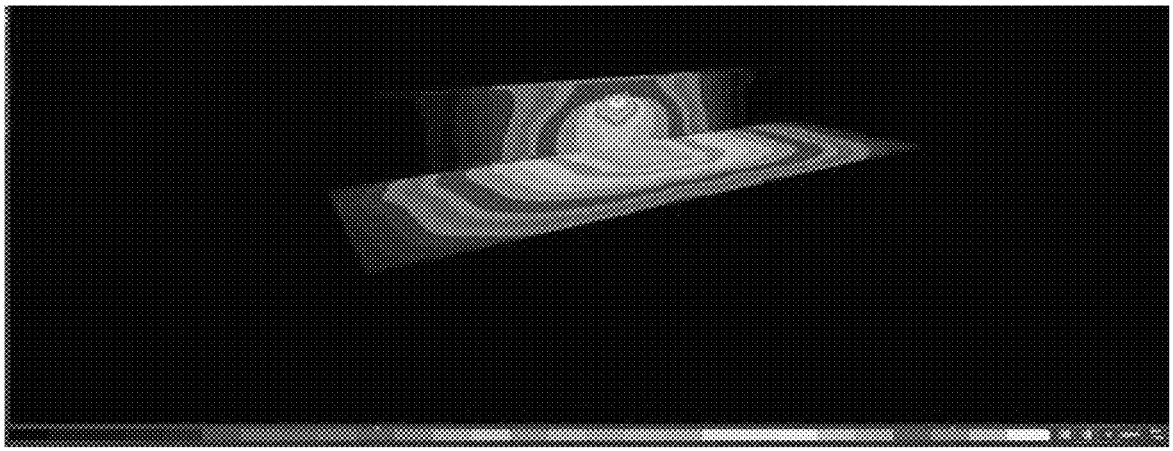
FIG. 17 is an exemplary photometric plot of the luminaire in a first mode.
Figure 18:
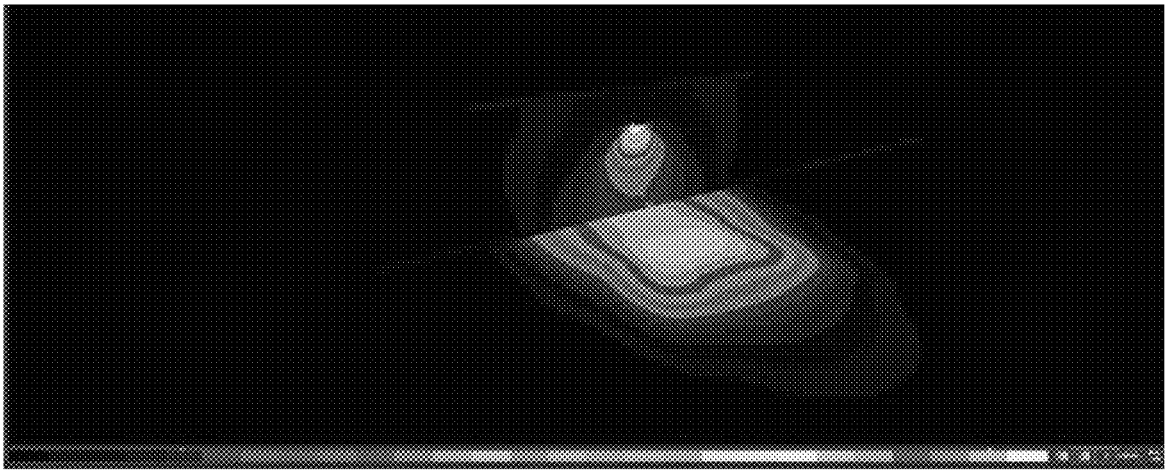
FIG. 18 is an exemplary photometric plot of the luminaire in a second mode

According to various exemplary embodiments, the luminaire 50 can be operated in different modes to produce different light outputs. For example, the luminaire 50 can be operated in a first mode and a second mode, where the second mode has a reduced light output from the first mode. As discussed above, certain control components allow the luminaire to operate in a normal mode when AC power is supplied and certain control components allow the luminaire to operate in an emergency mode under DC power supplied from a rechargeable battery. In normal mode, all the LEDs may be activated to provide a large area of light distribution as shown in FIG. 17. In the emergency mode, one or more LEDs are deactivated to save power. In an exemplary embodiment, only the LEDs associated with the first optic 116 are activated in emergency mode to produce a more reduced (for example narrower), forward throw of light output as shown in FIG. 18. Reducing the number of activated LEDs helps to conserve power and allows a smaller battery to be used. Also, the forward throw light output provides illumination to a specific area, for example in front of a door to provide better direction in case of an emergency.

Figure 19:
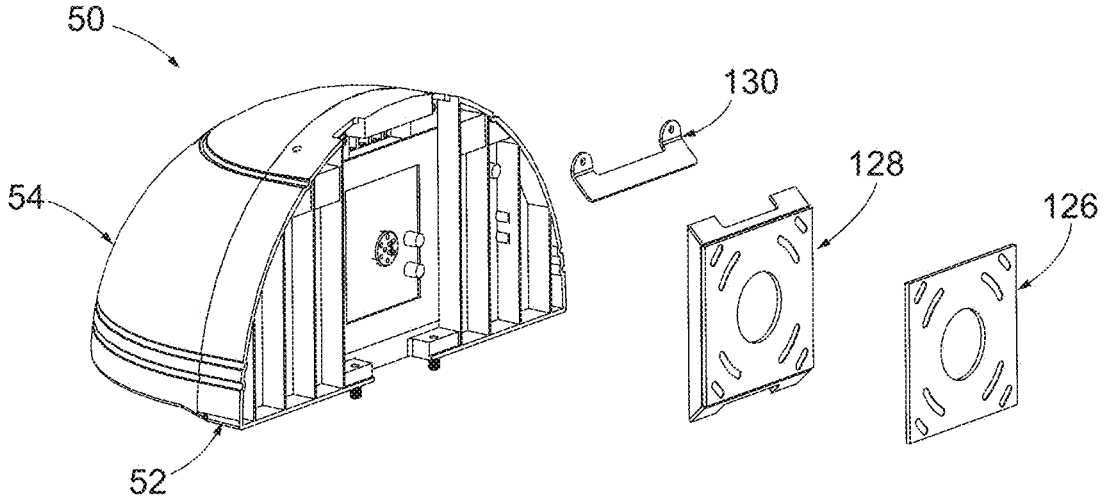
FIG. 19 is a rear perspective view of the luminaire of FIG. 6 and an exemplary mounting assembly.
Figure 20:
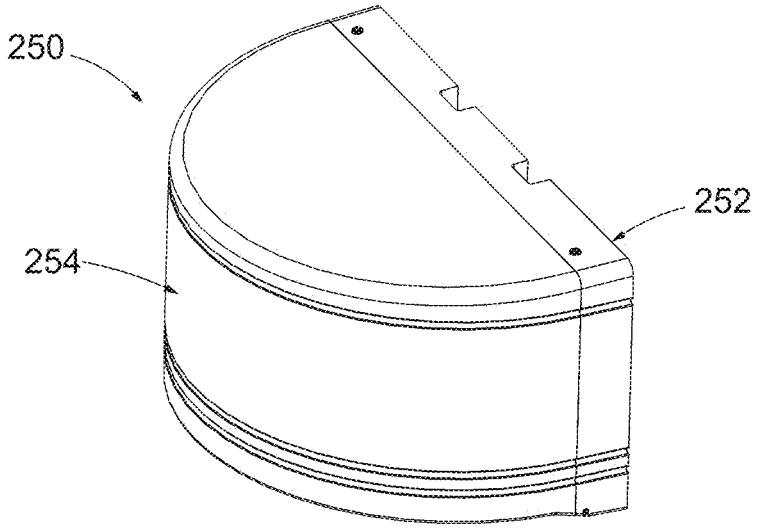
FIG. 20 is a top perspective view of another exemplary luminaire.
Figure 21:
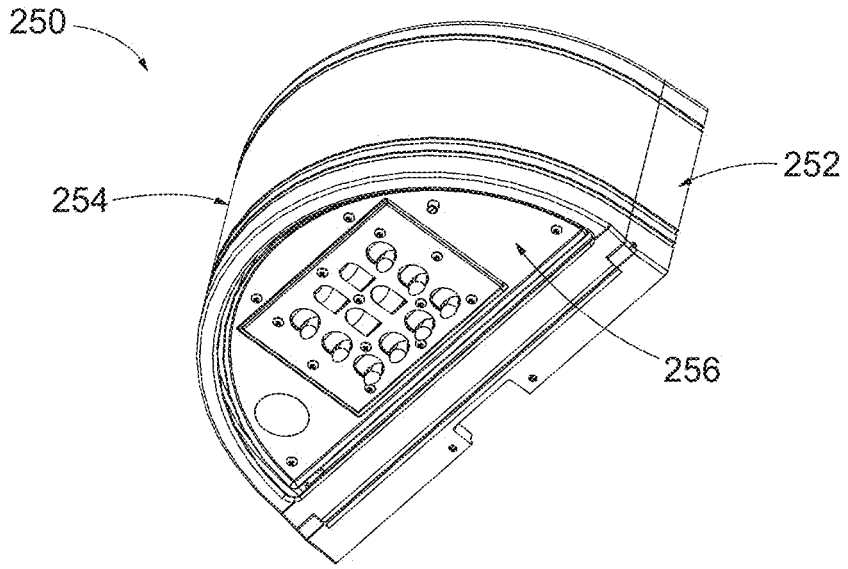
FIG. 21 is a bottom perspective view of FIG. 18.
Figure 22:
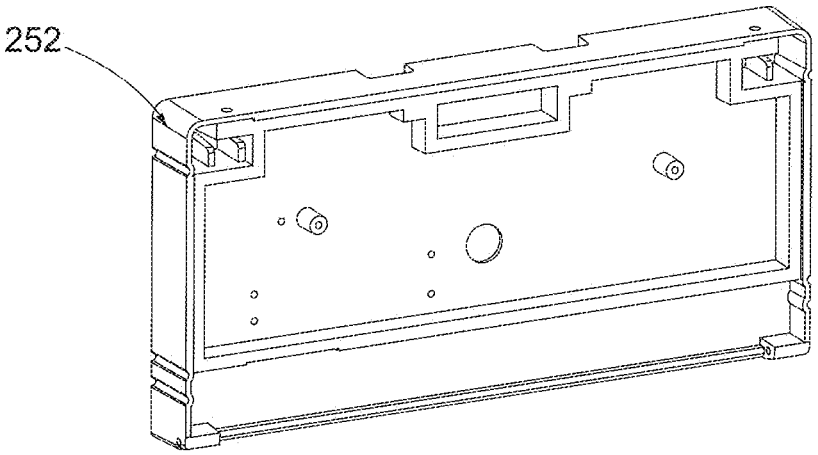
FIG. 22 is a front perspective view of the rear section of FIG. 18.
Figure 23:
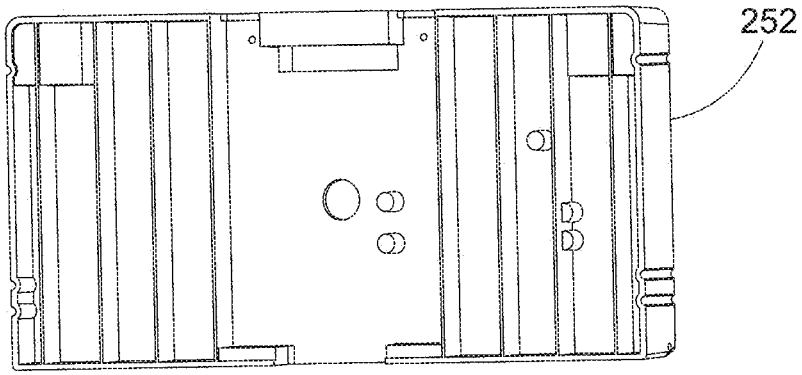
FIG. 23 is a rear perspective view of the rear section of FIG. 18.
Figure 24:
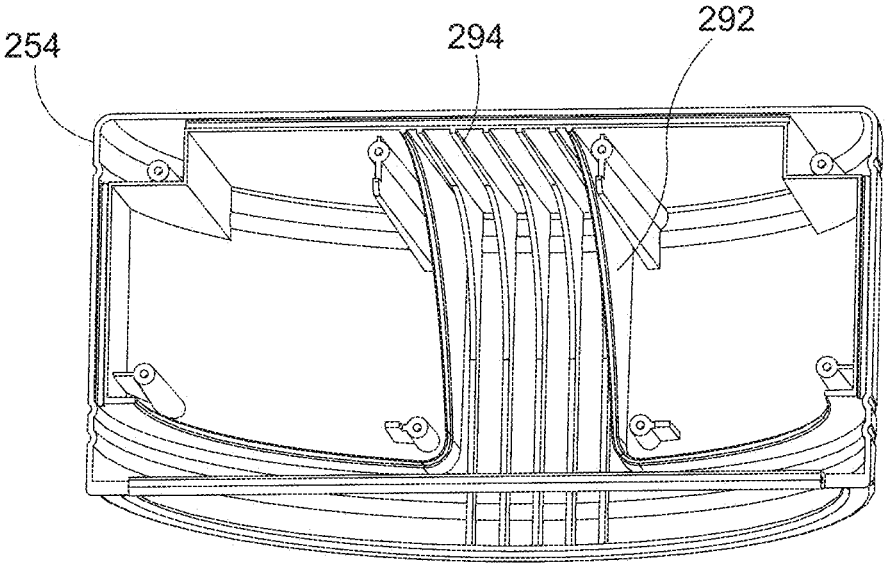
FIG. 24 is a rear perspective view of the cover of FIG. 18.
Figure 25:
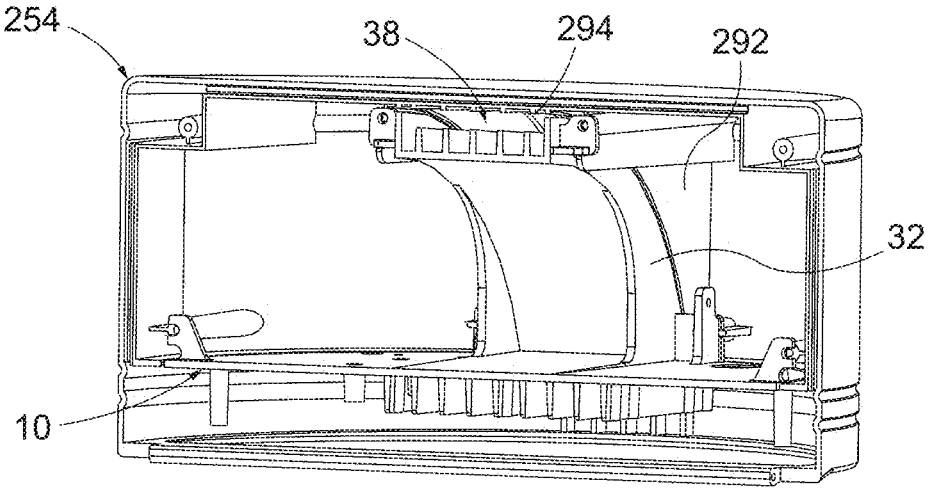
FIG. 25 is a rear perspective view of the cover of FIG. 18 and the insert.
Figure 26:
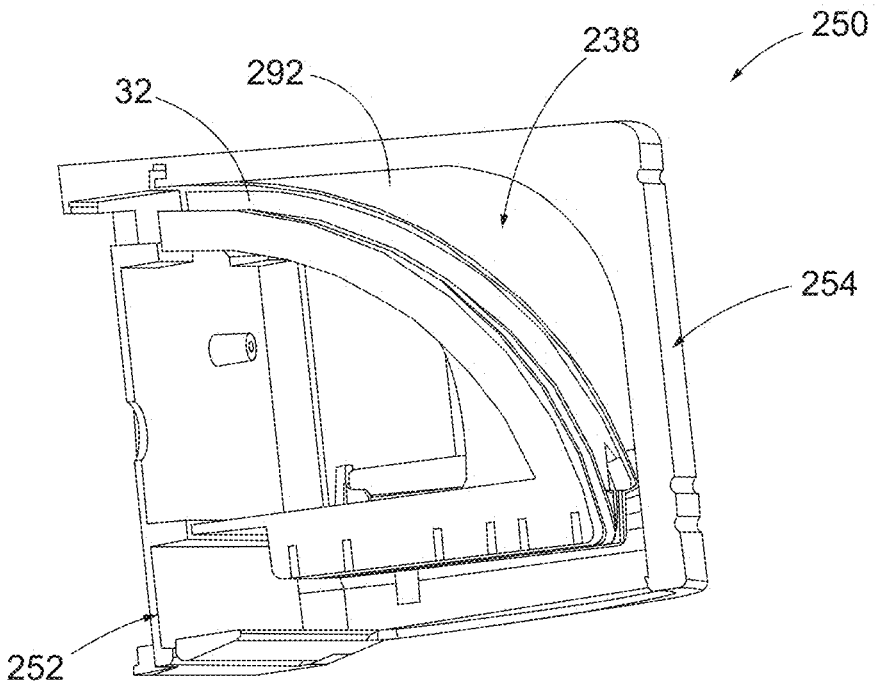
FIG. 26 is a sectional view of the rear section and cover of FIG. 18 and the insert.
Figure 27:
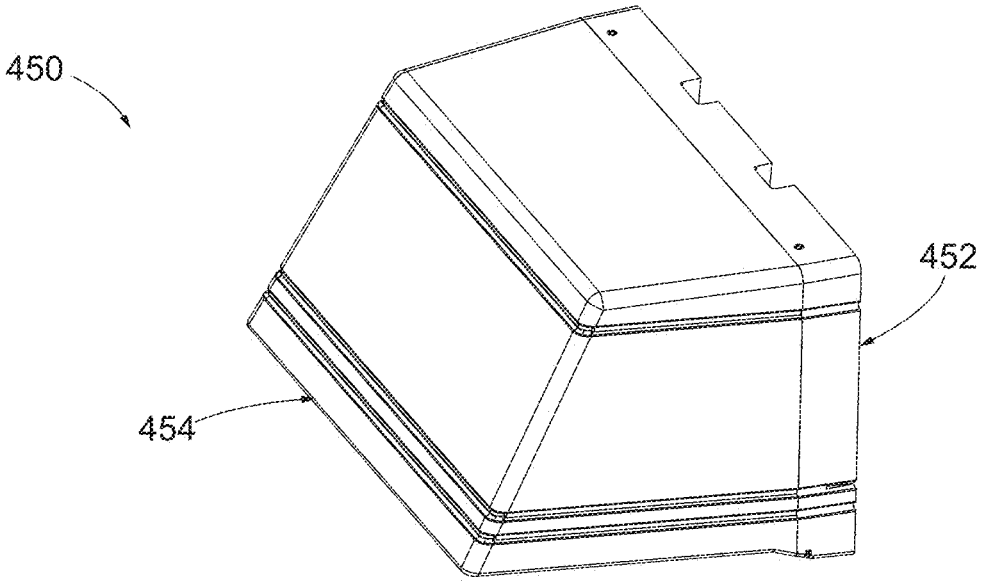
FIG. 27 is a top perspective view of another exemplary luminaire.
Figure 28:
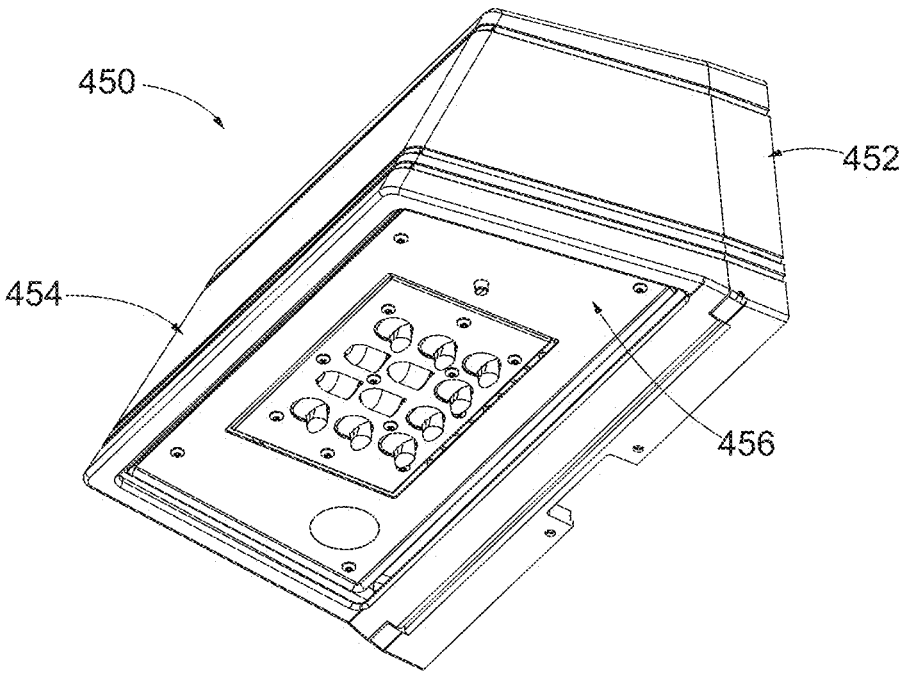
FIG. 28 is a bottom perspective view of FIG. 25.
Figure 29:
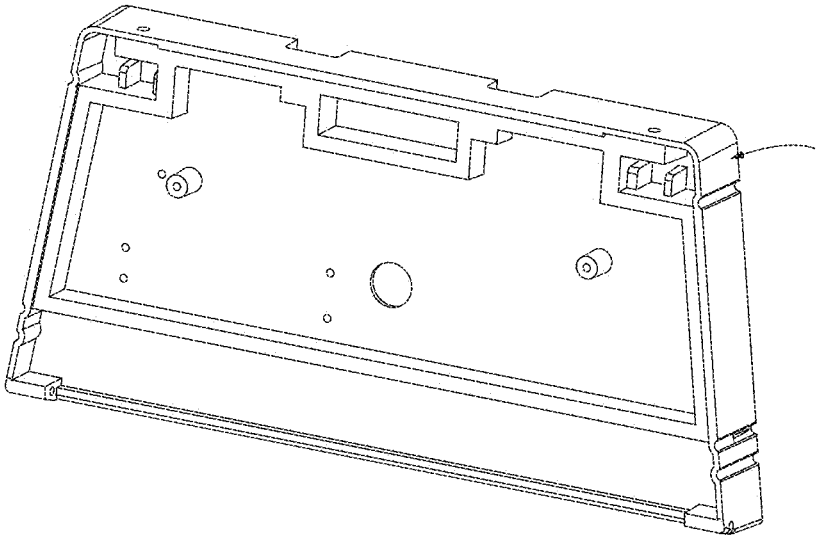
FIG. 29 is a front perspective view of the rear section of FIG. 25.
Figure 30:
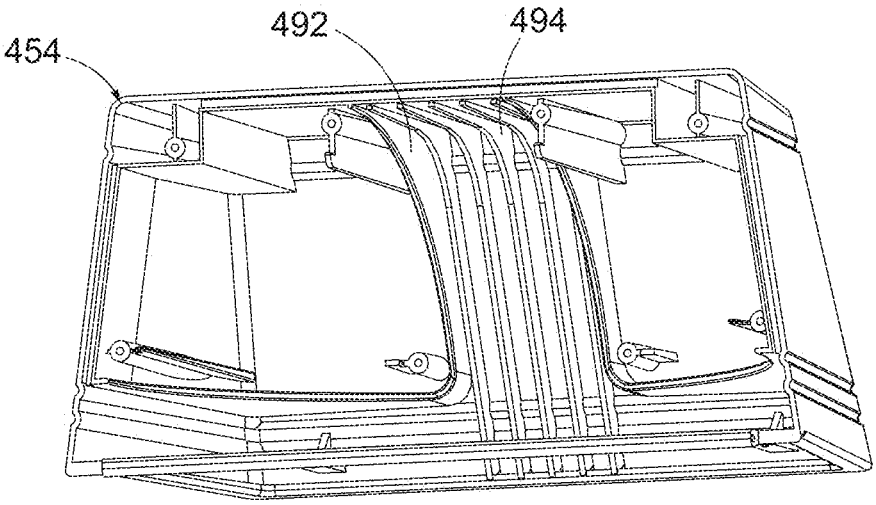
FIG. 30 is a rear perspective view of the cover of FIG. 25.
Figure 31:
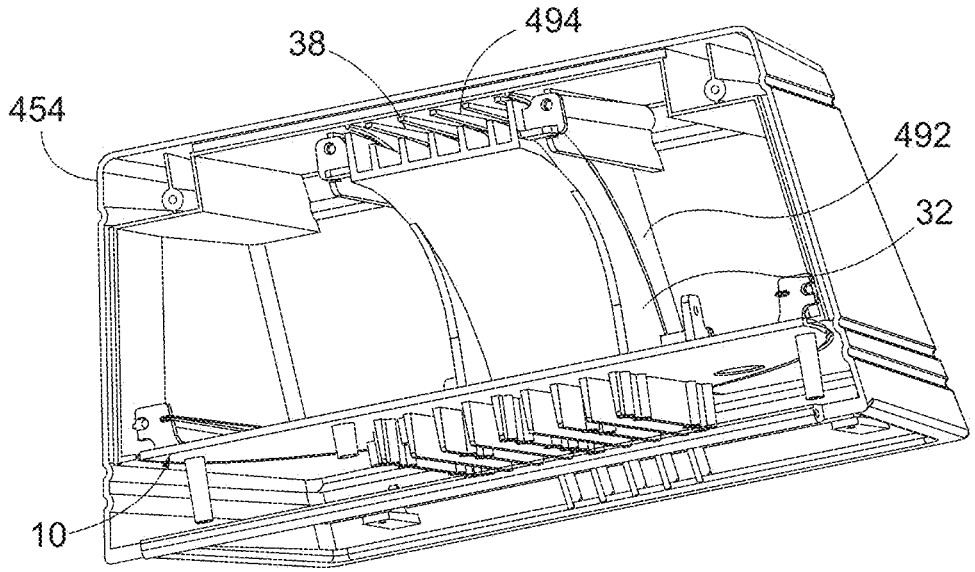
FIG. 31 is a rear perspective view of the cover of FIG. 25 and the insert.
Figure 32:
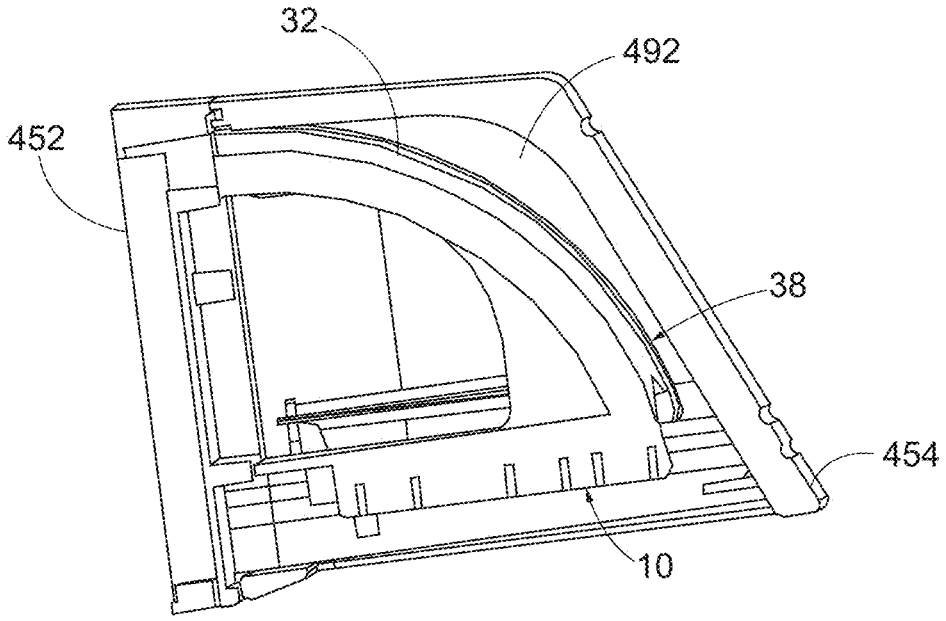
FIG. 32 is a sectional view of the rear section and cover of FIG. 25 and the insert.

FIG. 19 shows an exemplary mounting assembly 60 associated with the housing 50 used to attach the luminaire to a structure, for example a wall, post, or other type of support. The mounting assembly 60 includes a gasket 126, a mounting plate 128, and one or more mounting brackets 130. The mounting plate 128 and the gasket 126 include different openings to allow for different connections. The gasket 126 is placed against the structure and the mounting plate 128 is attached to the structure, for example through straps, bolts, screws, or other fasteners. The mounting bracket 130 is secured to the rear section 52. The mounting plate 128 includes a base and one or more angled walls extending from the base. The mounting bracket 130 includes an angled tab that engages the angled walls of the mounting plate 128. After the mounting plate 128 is connected to a structure, the housing 50 can be positioned adjacent the mounting plate 128 and the angled tab of the mounting bracket 130 can engage the angled wall of the mounting plate 128. The angled surfaces allow the housing 50 to slide down onto the mounting plate 128, providing easier mounting and forming a close engagement with the structure. One or more set screws can be used to further secure the housing 50 to the mounting plate 128.

FIGS. 20-26 show an exemplary embodiment of a half-round luminaire having a housing 250 that includes a rear section 252, a cover 254, and a cover plate 256. The half-round luminaire includes a light emitter assembly 258. Although the structure and layout differs from the quarter-sphere luminaire described above, the half-round luminaire utilizes the same insert 10 and can utilize the same or similar control components. The mounting components of the half-round luminaire are positioned similar to the quarter-sphere luminaire so that the insert 10 can connect to the half-round luminaire in a similar fashion. The half-round luminaire also includes outer fins 292 and central fins 294 that combine with the insert 10 to define an air passageway separated from the remainder of the housing.

FIGS. 27-32 show an exemplary embodiment of a trapezoid luminaire having a housing 450 that includes a rear section 452, a cover 454, and a cover plate 456. The luminaire also includes a light emitter assembly 458. Although the structure and layout differs from the quarter-sphere luminaire described above, the trapezoid luminaire utilizes the same insert 10 and can utilize the same or similar control components. The mounting components of the trapezoid luminaire are positioned similar to the quarter-sphere luminaire so that the insert 10 can connect to the trapezoid luminaire in a similar fashion. The trapezoid luminaire also includes outer fins 492 and central fins 494 that combine with the insert 10 to define an air passageway separated from the remainder of the housing.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a rear housing section having an opening in communication with an exterior environment;

a cover connected to the rear housing section, the cover at least partially surrounds an open area to define an interior;

an insert extending between the rear housing section and the cover, wherein the insert includes a base and a fin member extending from the base, and wherein at least a portion of the base and at least a portion of the fin member are positioned inside of the interior;

an air passageway formed between the insert and the cover and in fluid communication with the opening;

a control component connected to the base; and a light emitter assembly connected to the insert and controlled by the control component, wherein the insert provides thermal communication between the control component and the light emitter and the fluid passageway.

2. The luminaire of claim 1, wherein the fin member includes a first outer fin and a second outer fin and the cover includes a third outer fin aligned with the first outer fin and a fourth outer fin aligned with the second outer fin to at least partially define the air passageway.

3. The luminaire of claim 1, wherein the cover is pivotally connected to the rear housing section through a hinge member.

4. The luminaire of claim 1, wherein the base includes mounting components for connecting the insert to the cover.

5. The luminaire of claim 1, wherein the fin member includes a lower fin portion extending below the base and an upper fin portion extending above the base and curving from a front portion of the base to a back portion of the base.

6. The luminaire of claim 5, wherein the lower fin portion engages the light emitter assembly.

7. The luminaire of claim 1, further comprising a gasket positioned between the insert and the cover.

8. The luminaire of claim 1, wherein the light emitter assembly includes a first optic associated with a first LED and a second optic associated with a second LED, wherein the second optic produces a different light output than the first optic, and wherein the luminaire is configured to operate in a first mode where the first and second LEDs are activated and operate in a second mode where the first LED is activated and the second LED is deactivated.

9. The luminaire of claim 1, further comprising a mounting assembly configured to connect the rear housing section to an exterior wall.

10. A luminaire comprising:

a rear housing section;

a cover connected to the rear housing section;

an insert extending between the rear housing section and the cover, wherein the insert includes a base and a fin member extending from the base;

a set of control components positioned in the housing with at least one control component connected to the base;

a light emitter assembly connected to the insert and controlled by the control components, the light emitter assembly including a first set of light emitters, a first set of optics positioned over the first set of light emitters, a second set of light emitters, and a second set of optics positioned over the second set of light emitters, wherein the control components are configured to operate the light emitters assembly in a normal mode having a first light distribution and an emergency mode having a second light distribution different than the first light distribution.

11. The luminaire of claim 10, wherein the second optic produces a different light output than the first optic.

12. The luminaire of claim 10, wherein in the normal mode the first and second LEDs are activated and in the emergency mode where the first set of light emitters are activated and the second set of light emitters are deactivated.

13. The luminaire of claim 10, wherein the first set of optics are forward throw optics.

14. The luminaire of claim 10, wherein the second light distribution is narrower than the first light distribution.

15. The luminaire of claim 10, wherein the control components include a battery for powering the light emitters in emergency mode.

* * * * *